US012753593B2

(12) United States Patent
Appell et al.

(10) Patent No.: US 12,753,593 B2
(45) Date of Patent: Oct. 6, 2026

(54) APPARATUS WITH ACOUSTICALLY CONTROLLED FLOW RANGE, SYSTEM COMPRISING SUCH AN APPARATUS AND METHOD

(71) Applicant: Fraunhofer-Gesellschaft zur Förderung der angewandten Forschung e.V., Munich (DE)

(72) Inventors: Jens-Ekkehart Appell, Ilmenau (DE); Thomas Sporer, Ilmenau (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 25 days.

(21) Appl. No.: 18/972,804

(22) Filed: Dec. 6, 2024

(65) Prior Publication Data

US 2025/0101724 A1 Mar. 27, 2025

Related U.S. Application Data

(63) Continuation of application No. PCT/EP2023/065072, filed on Jun. 6, 2023.

(30) Foreign Application Priority Data

Jun. 7, 2022 (DE) ..... 102022205777.5

(51) Int. Cl.
*E03C 1/05* (2006.01)

(52) U.S. Cl.
CPC ..... *E03C 1/057* (2013.01)

(58) Field of Classification Search
CPC ..... E03C 1/057
See application file for complete search history.

(56) References Cited

U.S. PATENT DOCUMENTS

| | | | |
|---|---|---|---|
| 2001/0029785 | A1 | 10/2001 | Heaslip et al. |
| 2006/0174707 | A1 | 8/2006 | Zhang |
| 2008/0083893 | A1 | 4/2008 | Rubenstein |
| 2010/0200789 | A1 | 8/2010 | Connors |

(Continued)

FOREIGN PATENT DOCUMENTS

| | | | |
|---|---|---|---|
| JP | 2013504829 | A | 2/2013 |
| JP | 2017066730 | A | 4/2017 |

(Continued)

OTHER PUBLICATIONS

Japanese Office Action issued in corresponding Japanese Patent Application No. 2024-572095 dated Dec. 24, 2025, pp. 1-4.

(Continued)

*Primary Examiner* — P. Macade Nichols
(74) *Attorney, Agent, or Firm* — PV IP PC; Wei Te Chung

(57) ABSTRACT

An apparatus includes a flow range configured to let a fluid having a flow characteristic flow. The apparatus includes actuator means configured to change the flow characteristic of the flow range and further includes acoustic sensor means configured to receive an acoustic signal and to output a sensor signal based on the acoustic signal. The apparatus includes an analysis means configured to analyze the sensor signal to obtain an analysis result. The apparatus is configured to control the actuator means based on the analysis result for changing the flow characteristic.

22 Claims, 6 Drawing Sheets

(56) References Cited

U.S. PATENT DOCUMENTS

| | | | | |
|---|---|---|---|---|
| 2012/0017367 | A1* | 1/2012 | Reeder | E03C 1/057 4/597 |
| 2014/0076415 | A1 | 3/2014 | Dunki-Jacobs et al. | |
| 2014/0102541 | A1 | 4/2014 | Mittal et al. | |
| 2016/0369623 | A1 | 12/2016 | Ahmad et al. | |
| 2017/0072412 | A1 | 3/2017 | Hawkins | |
| 2017/0368565 | A1* | 12/2017 | Schoenbeck | E03C 1/057 |
| 2018/0216324 | A1 | 8/2018 | Beck et al. | |
| 2019/0094119 | A1 | 3/2019 | Singh et al. | |
| 2020/0122176 | A1* | 4/2020 | Floyd | G06N 3/09 |
| 2022/0081885 | A1* | 3/2022 | Leighton | E03C 1/057 |
| 2022/0163136 | A1 | 5/2022 | Li et al. | |

FOREIGN PATENT DOCUMENTS

| | | | |
|---|---|---|---|
| KR | 20220020231 | A | 2/2022 |
| WO | 2009037077 | A2 | 3/2009 |

OTHER PUBLICATIONS

German Office Action issued in corresponding German Patent Application No. 102022205777.5 dated Mar. 20, 2023, 16 pages.
International Preliminary Report on Patentability in International application No. PCT/EP2023/065072, dated May 6, 2024.
International Search Report in International application No. PCT/EP2023/065072, mailed on Aug. 17, 2023.
Written Opinion of the International Search Authority in International application No. PCT/EP2023/065072, mailed on Aug. 17, 2023.

* cited by examiner

APPARATUS WITH ACOUSTICALLY CONTROLLED FLOW RANGE, SYSTEM COMPRISING SUCH AN APPARATUS AND METHOD

CROSS-REFERENCE TO RELATED APPLICATIONS

This application is a continuation of copending International Application No. PCT/EP2023/065072, filed Jun. 6, 2023, which is incorporated herein by reference in its entirety, and additionally claims priority from German Application No. 102022205777.5, filed Jun. 7, 2022, which is also incorporated herein by reference in its entirety.

The present invention relates to an apparatus for acoustic control of a flow range, to a system comprising such an apparatus and to a method for controlling a flow of a fluid. The present invention relates in particular to the acoustic detection of the intended use of liquids and/or of operating aids with automatic liquid dosage.

BACKGROUND OF THE INVENTION

In particular in the kitchen, a lot of freshwater is used, frequently warm water. Depending on the intended use, there are very different requirements on the flow rate. If, for example, something has to be rinsed spontaneously under running water, such as a kitchen knife, a very low, possibly additionally focused flow rate is sufficient. If, however, a container is filled, such as a pot with water for cooking, a very large flow rate is desired for reasons of time efficiency, where the container quickly reaches the desired filling level.

The single-lever mixer taps that are common nowadays enable dosage of the amount of water and the temperature, but can often only be optimally adjusted with great sensitivity and a certain time effort, an effort that users normally cannot make. This results in excess water consumption. Currently, one option for focusing the water jet for low amounts of water exists at most with possible water-saving attachments which, however, inherently reduce the maximum flow rate.

Thus, there is a need for well-adjustable apparatuses for adjusting a flow range for fluids.

SUMMARY

According to an embodiment, an apparatus may have: a flow range configured to let a fluid having a fluid characteristic flow; actuator means configured to change the flow characteristic of the flow range; acoustic sensor means configured to receive an acoustic signal and to output a sensor signal based on the acoustic signal; analysis means configured to analyze the sensor signal to obtain an analysis result; wherein the apparatus is configured to control the actuator means based on the analysis result for changing the flow characteristic; wherein the analysis means is configured to analyze the sensor signal continuously or repeatedly over time for a sensor signal characteristic during a flow of the fluid, wherein an increasing filling level of a container filled with fluid correlates with a change of the sensor signal characteristic, wherein the apparatus is configured to control the actuator means to stop a flow of the fluid and to prevent overflow of the container based on reaching a predetermined sensor signal characteristic or a predetermined change of the sensor signal characteristic and/or wherein the analysis means is configured to analyze the sensor signal for a sensor signal characteristic of a transient event and to make a comparison with a plurality of predetermined sensor signal characteristics to obtain the analysis result, wherein the apparatus is configured to control the actuator means based on a similarity with one of the plurality of predetermined sensor signal characteristics; wherein a different control of the actuator means is allocated to each of the plurality of sensor signal characteristics.

According to another embodiment, a system may have an inventive apparatus and a collecting area formed as a wash basin.

According to another embodiment, a system may have an apparatus formed as tap, the apparatus having a flow range configured to let water having a fluid characteristic flow; actuator means configured to change the flow characteristic of the flow range; acoustic sensor means configured to receive an acoustic signal and to output a sensor signal based on the acoustic signal; analysis means configured to analyze the sensor signal to obtain an analysis result; wherein the apparatus is configured to control the actuator means based on the analysis result for changing the flow characteristic; a wash basin as collecting area for the water; wherein the acoustic signal is based on a putting-down sound in the collecting area and/or an object-related knocking sound at or in the collecting area; wherein the apparatus is configured to control the actuator means differently based on different locations of origin of the acoustic signal and/or patterns in the acoustic signal.

According to another embodiment, a method may have the steps of: analyzing a sound in an area or structure of a collecting area for a fluid to obtain an analysis result; controlling the flow of the fluid through a flow range based on the analysis result; such that the sensor signal is analyzed continuously or repeatedly over time for a sensor signal characteristic during a flow of the fluid, such that an increasing filling level of a container filled with fluid correlates with a change of the sensor signal characteristic, such that based on reaching a predetermined sensor signal characteristic or a predetermined change of the sensor signal characteristic the actuator means is controlled to stop a flow of the fluid and to prevent overflow of the container and/or such that the sensor signal is analyzed for a sensor signal characteristic of a transient event and a comparison with a plurality of predetermined sensor signal characteristics is made to obtain the analysis result, such that the actuator means is controlled based on a similarity with one of the plurality of predetermined sensor signal characteristics; such that a different control of the actuator means is allocated to each of the plurality of sensor signal characteristics.

Another embodiment may have a non-transitory digital storage medium having a computer program stored thereon to perform the inventive method when said computer program is run by a computer.

According to an embodiment, an apparatus includes a flow range that is configured to let a fluid with a flow characteristic flow. The apparatus includes actuator means configured to change the flow characteristic of the flow range. The apparatus includes acoustic sensor means configured to receive an acoustic signal and to output a sensor signal based on the acoustic signal. The apparatus includes analysis means configured to analyze the sensor signal to obtain an analysis result. The apparatus is configured to control the actuator means based on the analysis result for changing the flow characteristic.

Controlling the flow characteristic based on the acoustic sensor means and the analysis means enables adaptation of the flow characteristics based on the acoustic signal which enables good adjustability and is easy to implement.

According to an embodiment, the acoustic sensor means is configured to receive structure-borne sound of a collecting area, such as a wash basin, and to output the sensor signal based on the structure-borne sound. This enables reliable detection of sound waves as well as diversification, such as with regard to an origin of the structure-borne sound, which enables a high dimension of a solution space.

According to an embodiment, the acoustic sensor means is configured to receive airborne sound and to output the sensor signal based on the airborne sound. Airborne sound enables, for example, interaction between fluid and an object, on which the fluid impinges, to be analyzed and/or voice recognition to be performed. Both concepts can be received in the sensor means alternatively or in combination.

According to an embodiment, the fluid is a liquid, in particular water. This enables, for example, implementation in wash basins and a reduction or optimization of water consumption.

According to an embodiment, the flow characteristic is at least one of a start or an end of the flow, a flow rate of the fluid, a flow velocity of the fluid, a flow duration of the fluid, a focusing of the fluid in an outlet area of the flow range, a composition of the fluid from a plurality of fluid sources and a temperature of the fluid, which enables precise adjustment.

According to an embodiment, the analysis means is configured to analyze the sensor signal continuously or repeatedly over time for a sensor signal characteristic during a flow of the fluid, wherein the apparatus is configured to control the actuator means to stop a flow of the fluid based on reaching a predetermined set value or threshold of the sensor signal characteristic. This enables an automatic and situation-adapted stop of the fluid flow.

The analysis means can be configured to analyze the sensor signal in a time domain and/or in a frequency domain for one or several characteristics. For example, analysis can take place in response to reaching a specific amplitude value in the time domain and/or in the frequency domain, as well as the analysis of a temporal repetition or repetition rate of occurring events. For distinguishing events, frequency domain analysis can be advantageous, for example by deriving and/or analyzing a spectrum based on the sensor signal.

According to an embodiment, the analysis means is configured to analyze a spectrum of the sensor signal continuously or repeatedly over time during a flow of the fluid. An increasing filling level of a container filled with the fluid can correlate with an increasing frequency of the spectrum. The apparatus is configured, for example, to control the actuator means to stop a flow of the fluid based on reaching a predetermined frequency and/or based on reaching a predetermined increase of the frequency starting from an original value. This means, when reaching a respective frequency or after detecting a frequency change, the system detects the filling level of the container and stops the flow at or prior to overflow of the same. Thereby, waste is prevented.

According to an embodiment, the apparatus is configured to control the actuator means to stop the flow based on information in the sensor signal that a container to be filled with the fluid is filled or flows over. Automatic termination of the flow enables low losses or waste of the fluid. When using the sensor signal as information source, such a behavior can be easily controlled, in particular automated.

According to an embodiment, the analysis means is configured to analyze the sensor signal for a number of subsequent repetitions of a transient event, such as caused by knocking sounds, to obtain the analysis result. The apparatus is configured to control the actuator means differently based on different numbers of repetitions. This enables easy control, such as by a different number of transient events.

According to an embodiment, the analysis means is configured to analyze the sensor signal for a spectrum of a transient event, which correlates, for example, with a location where the transient event is caused. The apparatus is configured to make a comparison with a number of predetermined spectra to obtain the analysis result. The apparatus is configured to control the actuator means based on a similarity with one of the plurality of predetermined spectra and to allocate a different control of the actuator means to each of the plurality of spectra. As an alternative or in addition to the number of repetitions of a transient event, in embodiments, a location of the transient event can be evaluated, which can be provided with differing information, such that an improved adjustment of the fluid flow is enabled by considering the same.

According to an embodiment, the plurality of different spectra is associated with at least one of a location of origin of the transient event and a condition of the object triggering the transient event. This enables very good adjustment of the flow characteristic as, for example, the object treated with the fluid can be inferred or at least a predetermined differentiation can be used, since, for example, rinsing of a knife is treated differently than filling a container.

According to an embodiment, the analysis means is configured to analyze the sensor signal for a voice command, wherein the apparatus is configured to control the actuator means according to the detected voice command. This enables precise control of the fluid by means of speech.

According to an embodiment, the apparatus is configured for a learning operating mode and an execution mode. The apparatus is configured to obtain at least one piece of information regarding a sensor signal in the learning mode, for example from the acoustic sensor means or by means of programming, and to obtain one piece of information regarding control of the actuator means and to combine the information regarding the sensor signal with the information regarding the control means. In the execution mode, the apparatus is configured to execute control of the actuator means based on the matter learned in the learning operating mode. This enables adaptation of the apparatus to individual and/or time-varying environmental conditions.

According to an embodiment, the apparatus is configured as water tap, filling means, filling level monitoring means, rinsing means or dosing means. This enables various applications of the embodiments described herein.

According to an embodiment, a system includes an apparatus described herein and a collecting area. According to an embodiment, the acoustic sensor means is configured to receive structure-borne sound from the collecting area, wherein the apparatus is configured to control, based on different characteristics of the structure-borne sound, by controlling the actuator means, at least one of a flow rate of the fluid, a flow velocity of the fluid, a flow duration of the fluid, a focusing of the fluid in an outlet area of the flow range, a temperature of the fluid and a composition of the fluid from a plurality of fluid sources. The analysis of structure-borne sound, in particular of the collecting area, enables large error, robustness, as structure-borne sound is at most only slightly influenced by ambient sound, such as the leaking fluid.

According to an embodiment, the acoustic signal is based on a putting-down sound in the collecting area. Alternatively or additionally, the acoustic signal is based on an object-related knocking sound at or in the collecting area. The apparatus is configured to control the actuator means differently based on different locations of origin of the acoustic signal and/or patterns in the acoustic signal. This enables simple and reliable control of the flow range, possibly already based on the operating sounds that are output when using and/or introducing the respective objects in the collecting area.

According to an embodiment, the system is configured to start the flow of the fluid automatically or in dependence on a subsequent knocking sound when putting down a container into the collecting area. This enables effortless start of the flow.

According to an embodiment, the system is configured to stop the flow of the fluid automatically when putting down a container in the collecting area as soon as the sensor signal indicates filling or overfilling of the container. In that way, for example, when placing the container, filing can be started automatically and when reaching the filling level, filling can be terminated.

According to an embodiment, the system is configured to analyze a sound generated by the fluid in or at the collecting area by the sensor means and the analyzing means and to adjust, with the actuator means, based on the correspondence with one of a plurality of different sounds, a focusing of the fluid from a plurality of different focusings allocated to the corresponding sound. Alternately or additionally, with the actuator means, based on a correspondence with one of a plurality of different sounds, the system can adjust a flow rate of the fluid of a plurality of different flow rates allocated to the corresponding sound. In that way, based on different detected and analyzed sounds, the system can adjust different adjustments of the focusing and/or flow rate which is advantageous with respect to consumption and the time needed.

According to an embodiment, a method includes analyzing a sound in an area or a structure of a collecting area for a fluid to obtain an analysis result. The method includes controlling the flow of the fluid through a flow range based on the analysis result. Here, similar advantages as in the inventive apparatus are obtained.

According to an embodiment, the sound includes a voice command, a mechanical contact with the area or structure of the collecting area, and controlling includes starting or stopping the flow. This enables reliable and robust good adjustment of the fluid flow.

According to an embodiment, the sound is generated by the fluid and controlling includes adapting the flow rate, the flow velocity, the fluid temperature, stopping the flow or adjusting a focusing of the fluid during outlet from the flow range.

BRIEF DESCRIPTION OF THE DRAWINGS

Embodiments of the present invention will be detailed subsequently referring to the appended drawings, in which.

DETAILED DESCRIPTION OF THE INVENTION

Before embodiments of the present invention will be discussed below in detail based on the drawings, it should be noted that identical, functionally equal or equal elements objects and/or structures in the different figures are provided with the same reference numbers, such that the description of these elements illustrated in different embodiment is inter-exchangeable or inter-applicable.

Embodiments described below are described in the context of a plurality of details. However, embodiments can also be implemented without these detailed features. Further, for clarity reasons, embodiments are described by using block diagrams instead of a detailed illustration. Further, details and/or features of individual embodiments can easily be combined as long as it is not explicitly described to the contrary.

The following embodiments relate to a flow range configured to let a fluid having a flow characteristic flow. The fluid can be configured in a liquid manner, but embodiments are not limited to that. Gaseous fluids transported, for example, in a pressure container or filled into a container or discharged from the same can also be used with embodiments described herein.

Some of the embodiments described herein particularly relate to a water tap or the same providing a flow range and configured to dispense water as fluid into a wash basin as collecting area for the fluid. Here, the present invention relates to controlling the flow characteristic based on an acoustic signal. Therefore, the embodiments described herein are neither limited to water as fluid nor to a wash basin as collecting area, if existing, nor to a water tap or the same as flow range. As an alternative or in addition to a water tap, an apparatus described herein can be formed as filling means for filling a fluid to be filled, filling level monitoring means for monitoring a filling level of a fluid, rinsing means and/or dosing means.

Figure 1:
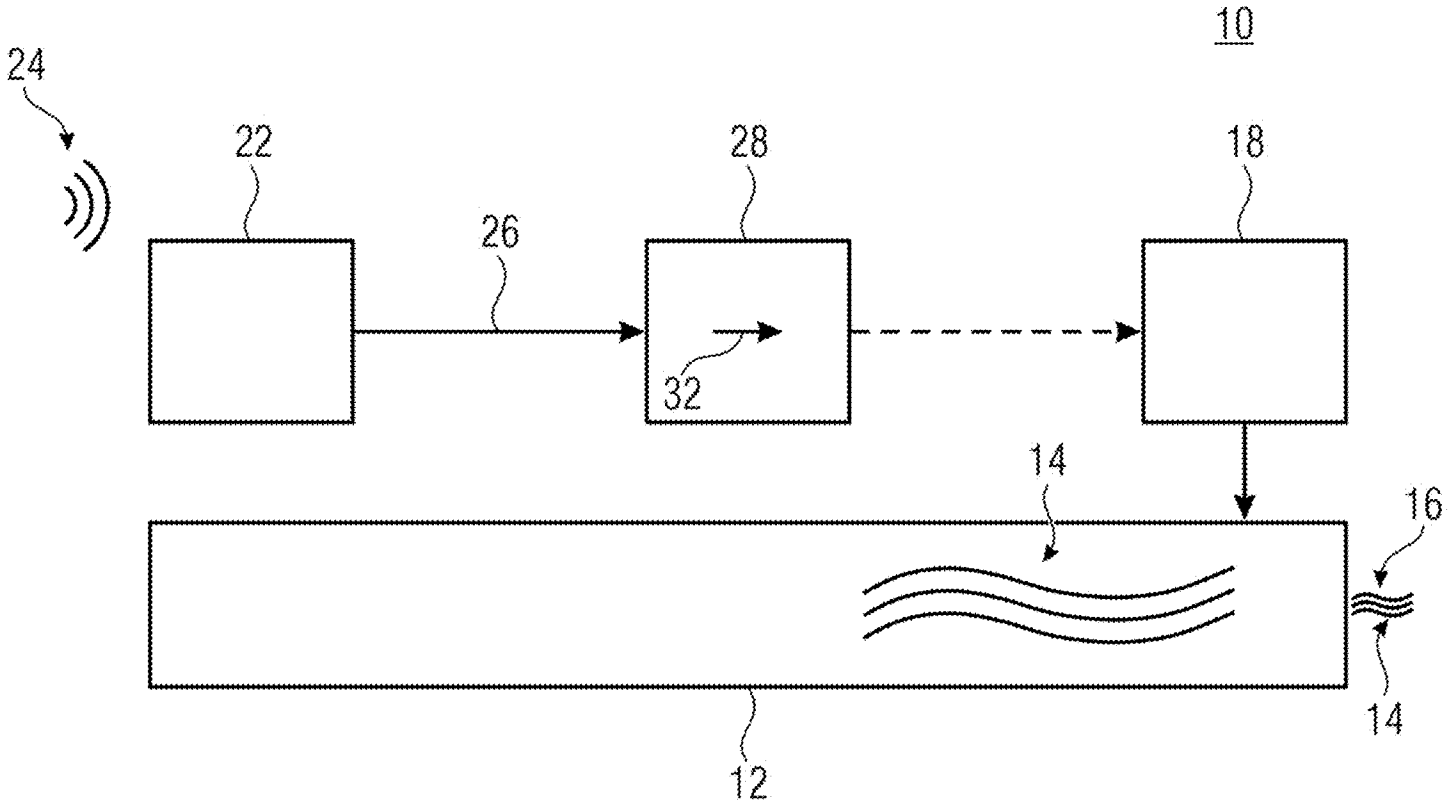
FIG. 1 is a schematic block diagram of an apparatus according to an embodiment.

FIG. 1 shows a schematic block diagram of an apparatus 10 according to an embodiment. The apparatus 10 includes a flow range 12 configured to let a fluid 14 having a flow characteristic flow.

The fluid characteristic can include, for example, a beginning or an end of the flow, can relate to a flow rate of the fluid, a flow velocity of the fluid, a flow duration of the fluid, a focusing of the fluid in an outlet area 16, such in the area of an aerator or the same, to a composition of the fluid from a plurality of fluid sources and/or to a temperature of the fluid 14.

Actuator means 18 of the apparatus 10 is configured to change or adjust the flow characteristic of the flow range 12. If the flow characteristic is, for example, a beginning or an end of the flow, the change of the flow characteristic relates, for example, to opening or closing of a valve. If the flow characteristic is, for example a flow rate of the fluid, the same can be adjusted by the actuator means 18, for example, by adjusting the duration during which a valve is opened and/or via the opening degree within a specific time period.

The apparatus 10 includes acoustic sensor means 22 configured to receive an acoustic signal 24 and to output a sensor signal 26 based on the acoustic signal 24. Further, the apparatus includes analysis means 28 configured to analyze the sensor signal 26 to obtain an analysis result 32.

The apparatus 10 is configured to control the actuator means 18 based on the analysis result 32 for changing the flow characteristic. This can take place directly with the analysis means 28 and/or by using intermediate means, such as processor means, control means, a microcontroller or the same.

The sensor means 22 can be configured to receive structure-borne sound of a collecting area and/or to receive airborne sound. In that way, the acoustic signal 24 can be structure-borne sound but can alternatively also include airborne sound.

The analysis means 28 can be configured to evaluate the sensor signal 26 with respect to frequency response, a spectrum, an amplitude, a duration, a number of repetitions or repetition rate, in particular of transient events or the like. This does not exclude further or more computing-intensive evaluations, such as voice evaluation or the like. The analysis means can be configured to perform the analysis such that an analysis result, such as a determined signal amplitude, a repetition rate, a characteristic of a spectrum, such as frequencies included or not included therein, frequency portions, amplitudes or frequencies or a change of the frequency response over time is compared with values that are stored in a data storage that is not illustrated, such as comparison values or thresholds. Alternatively or additionally, spectra or their representatives can be stored in such a data storage and can be used by the analysis means 32 for a similarity comparison or the like, which can be used, for example, to allocate a location of an occurring event by means of a comparison, such as when different locations are allocated to different control actions.

The sensor means 22 can be configured to output the sensor signal 26 continuously or discretely over time or based on respective triggers. The analysis means 28 can be configured to evaluate the sensor signal 26 prior to, during or after the flow of the fluid 14. Evaluation by the analysis means 28 can take place continuously or repeatedly over time. In that way, the analysis means 28 can analyze the sensor signal for a sensor characteristic, for example amplitudes or frequency portions. The apparatus 10 can be configured to control the actuator means 18 to stop the flow of the fluid 14 after a start of the flow of the fluid 14 after a start of the flow of the fluid 14 through the flow range 12 when reaching a predetermined set value of a sensor characteristic and/or when reaching a respective threshold of the sensor signal characteristic.

In that way, for example a container to be filled can be arranged such that the same receives the fluid 14 from the outlet area 16. Impinging of the fluid in the container can result in sound generation, wherein frequency portions of this sound can be based on the decreasing free volume of the container. The decreasing free volume can result in an increase of frequency portions, such that, for example reaching predetermined frequencies and/or reaching a predetermined increase of the frequency based on the original value are interpreted by the analysis means 28 such that the apparatus 10 controls the actuator means 18 so as to stop the flow of the fluid 14. This is obtained, for example in that the analysis means 28 repeatedly analyzes a spectrum of the sensor signal 26 continuously or discretely over time during the flow of the fluid 14. In other words, the analysis means 28 can be configured to evaluate the sensor signal 26 for a frequency change and/or a sound change in the acoustic signal 24.

According to an embodiment, the apparatus is configured to control the actuator means 18 to stop the flow of the fluid based on an information in the sensor signal 26, such as the changing frequency portions, that a container to be filled with the fluid is filled or flows over.

Figure 2:
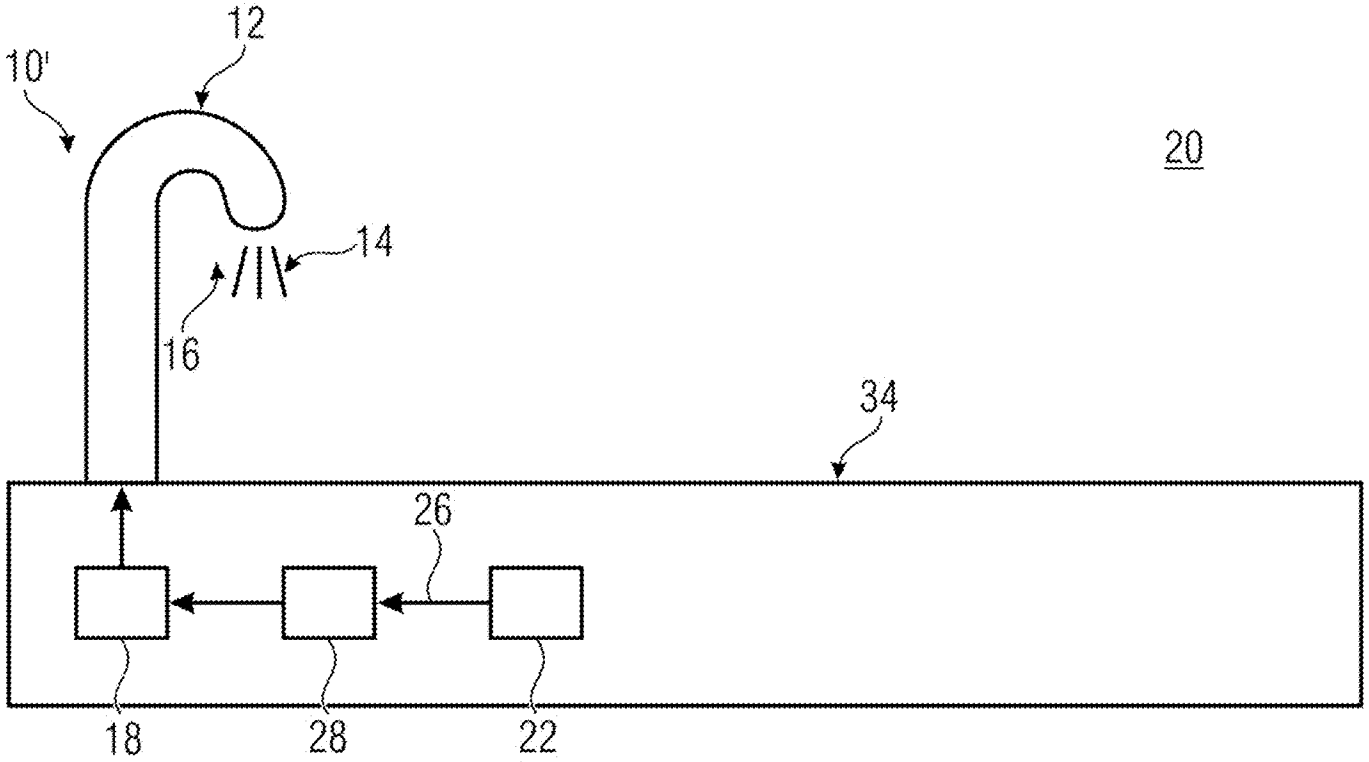
FIG. 2 is a schematic side sectional view of a system according to an embodiment.

FIG. 2 shows a schematic side section view of a system 20 according to an embodiment. The same comprises a configuration 10' of the apparatus 10 wherein, for example, the flow range 12 is formed as water tap and the fluid 14 includes water.

The system 20 includes a collecting area 34 configured to collect the fluid 14. The collecting area 14 can, in particular include a basin, such a sink, a wash basin or the same. The sensor means 22 can include, for example, a microphone monitoring sound in the filling area or collecting area 34. Alternatively or additionally, a microphone for structure-borne sound can also be provided.

The sensor means 22, the analysis means 28 and the actuator means 18 can be integrated individually or in combination with one or several other components in the flow range 12, such as the water tap and/or the collecting area 34, or can be in contact with these components as individual components in radio connection or by means of wired connection.

The sensor means 22 can be configured to detect structure-borne sound of the flow range 12, the collecting area 34 or other components mechanically connected therewith. Alternatively or additionally, the acoustic sensor means 22 can be configured to receive airborne sound, particularly in an area of the collecting area 34.

For controlling the water tap 12, for example, apart from a start and/or end of the flow, alternatively or additionally, one or several of a flow rate of the fluid 14, a flow velocity of the fluid 14, a flow duration of the fluid or the like or also other characteristics of the flow can be controlled. Thus for example, a focusing of the fluid 14 in the outlet area 16 of the flow range 12 can be adjusted. Focusing can mean, for example, a variable jet strength or jet diameter and/or dividing of a jet flowing comparatively slow into several smaller jets flowing at higher velocity. Alternatively or additionally, a composition of the fluid from a plurality of fluid sources can be adjusted. In the example of the water tap, this can include, for example, individual control of the inflow of cold water and hot water, wherein, apart from the flow rate, the temperature can also be adjusted. Alternatively or additionally, a temperature of the fluid 14 can be adjusted by adjusting a heating strength of washing faucet, which is, for example configured to merely receive cold water and then heat the same with energy, such as electric current, as it passes through. If this example is transferred to other technical fields, such as filling plants or the same, this results in the fact that also a higher number of fluid sources can be controlled individually or in combination.

Figure 3:
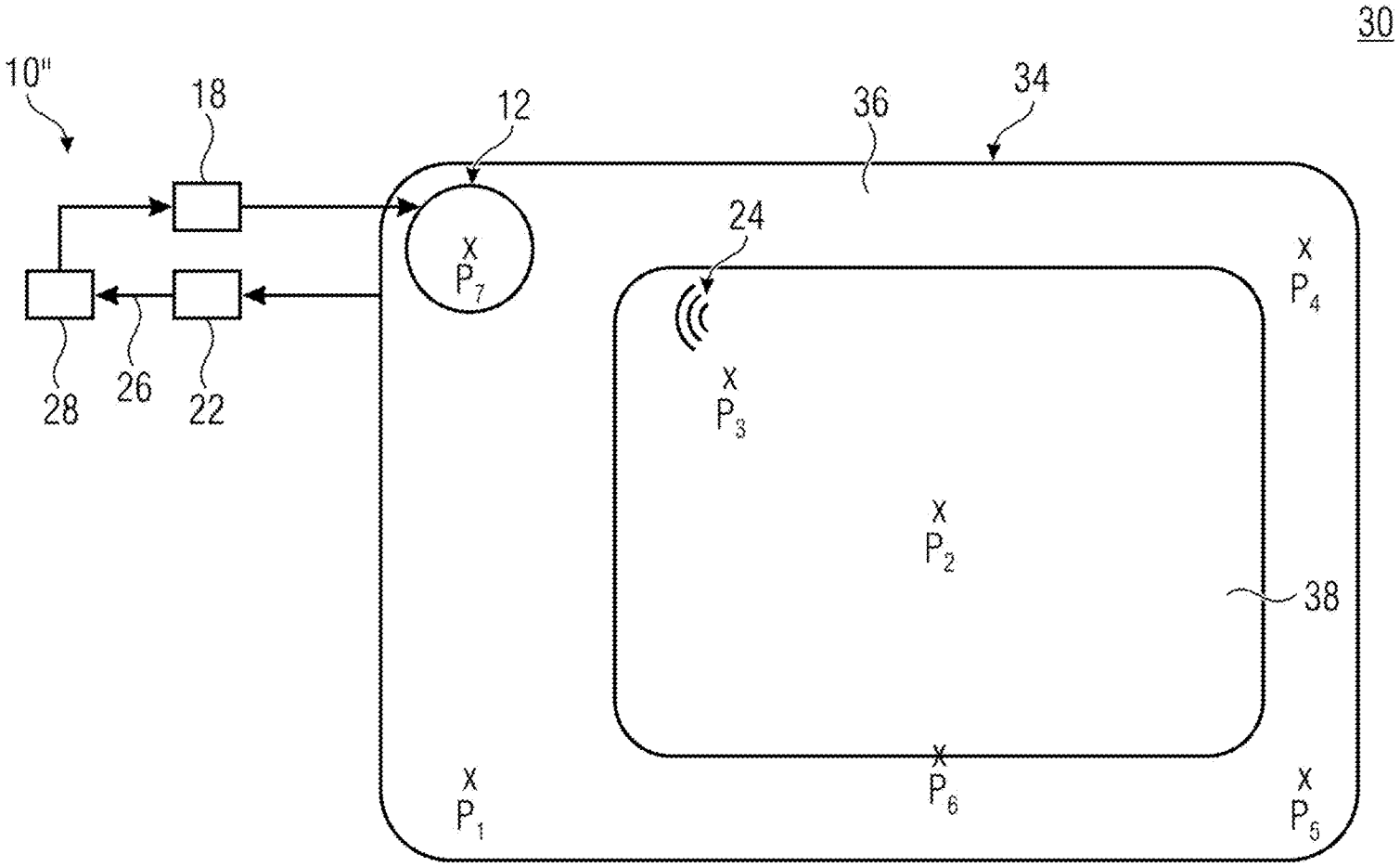
FIG. 3 is a schematic top view of a system according to an embodiment.

FIG. 3 shows a schematic top view of a system 30 according to any embodiment which can essentially include the components of the system 20 and based on which particularly advantageous configurations of the present invention will be discussed in more detail.

The sensor means 22 is configured in the system 30 to detect at least structure-borne sound from an area of the collecting area 34. Merely exemplarily, the receiving or collecting area 34 comprises an edge area 36 and a basin area 38 possibly recessed with respect to the same. Based on differing configurations, material strengths and/or distances to the sensor means 22, the acoustic signal 24 that results at different locations $p_1$-$p_7$ due to a possibly transient event, can differ, for example in the spectral range. For example, knocking sounds can be used as transient event. Such knocking sounds can result from a user knocking by a finger, the fist, the elbow or the same on one of the locations $P_1$-$P_7$, wherein this is not limiting. Sweeping across a surface can also generate a characteristic in the sensor signal as non-transient event. Alternatively or additionally, a possibly transient sound can also be obtained by putting down a subject, for example when a pot or glass or the same is put down in the basin area 38. In that way, the acoustic signal 24 cannot only distinguish between similar events based on the location $P_1$-$P_7$, but can also provide conclusions on what exactly has caused the event due to the evaluation in the analysis means 28. The different locations can be, for example, in the basin area 38, adjacent thereto or also the water tap itself at the location $P_7$, i.e. embodiments enable detecting a knock or the same at the water tap and performing a predetermined action based thereon.

According to an embodiment, the analysis means 28 can analyze the sensor signal such that the sensor signal 26 is analyzed for a spectrum of a transient event and a comparison with a plurality of predetermined spectra is performed to obtain the analysis result 32. The apparatus in the system 30 can be configured to control the actuator means 18 based on a similarity with one of the plurality of predetermined spectra, wherein a different control of the actuator means is allocated to each of the plurality of spectra. Thus for example, a knock at one of the locations $P_1$, $P_4$ and $P_5$ can be associated with an individual or at least groupwise differing instruction, for example water start, water stop, water hotter, water cooler or a specific flow duration.

Alternatively or additionally, the analysis means 28 can be configured to analyze the sensor signal 26 for a number of subsequent repetitions of a transient event, such as knocking sounds, to obtain the analysis result 32. The apparatus in the system 30 can be configured to control the actuator means differently based on different numbers. Thus, for example, a first number of transient sounds can indicate a start of a flow and a differing number or renewed knocks of the same number can be used to stop the flow again.

The plurality of different spectra evaluated by the analysis means 28 for comparison purposes can be stored, for example in a data storage coupled indirectly or directly to the analysis means. However, it is not mandatory to store a respective spectrum. Alternatively or additionally, characteristic parameters evaluated for the control can also be stored fully or partly or information enabling the derivation of the determining parameters or reference parameters.

Here, the different entries of the data storage can be associated with a respective location of origin of the transient event and/or a condition of the object triggering the transient event, such as finger, pots, glass or the same. This allows, for example, control by the analysis means 28 or means receiving the evaluation result 32, such that a differentiation or identification is made whether a glass or a pot is put down in the basin area 38, where upon the system 30 automatically starts the water flow. For example, cold water can be used for a glass, or warm or hot water for a pot.

Alternatively or additionally, the acoustic sensor means 22 of the apparatus 10, the system 20 and/or the system 30 can be configured to receive airborne sound as acoustic sensor signal 24. Even when the usage of airborne sound is not mandatory, it is in particular advantageous for a configuration of the analysis means 28 such that the same analyzes, during a flow of the fluid, the sensor signal 26 continuously or repeatedly over time for a sensor signal characteristic, such as frequency portions and spectrum, wherein the apparatus of the system 30 an be configured to control the actuator means to stop a flow of the fluid based on reaching the predetermined set value or threshold of the sensor signal characteristic. This means that the system 20 and/or 30 cannot only be configured to control the flow range 12, but that also automatic activation of the flow can take place, when, for example, a pot or a glass is placed into the collecting area 34, and at the same time an analysis is made when the fluid is to be switched off again, for example by monitoring when the frequency portions have significantly increased or have reached a threshold.

This does not exclude that the analysis means 28 of an apparatus described herein is configured to analyze the sensor signal for a voice command, in particular when receiving airborne sound. Such an apparatus can be provided with voice analysis detection, wherein the apparatus is configured to control the actuator means 18 according to a detected voice command.

Compared to systems, where, for example, a voice assistant is used to request the meaning of a voice command online and to receive a control command from the internet, which is then routed to a tap by the voice assistant, systems described herein differ in that at least the acoustic sensor means 22 is part of the apparatus and/or the system and is integrated, for example, in the apparatus or the flow range 12 and/or in the collecting area 34.

An apparatus described herein can be preconfigured but can also be configurable completely or partly by a user. For this, an apparatus described herein can comprise a learning operating mode and an execution mode. In the learning operating mode, the apparatus can obtain at least one piece of information regarding a sensor signal, such as from the acoustic sensor means 22, and one piece of information regarding a control of the actuator means. For example, a knocking sound or a different information source can be adjusted in a specific context with a manually adjusted control of the actuator means and can be stored in a data storage of the apparatus. Thus, the information regarding the sensor signal 26 can be combined with the information regarding the control, e.g. in a data storage. During the learning operating mode, several pieces of information can be provided, wherein this can be the same or corresponding information or differing information, such as based on a respective learning concept.

The apparatus can be configured to perform control of the actuator means in the execution mode based on what was learned in the learning operating mode. Such a learning mode allows, for example, adjustment of a filling level of a pot and/or a desired temperature in advance, which then can be retrieved when the knocking sounds occur, such as location-related knocking sounds (locations $P_1$ to $P_7$) or object related knocking sounds (finger, glass, pot, . . . ).

The analysis means 28 can comprise a neural network that can be trained in the learning mode, such as for analyzing the acoustic signal. For this, the neural network can be provided with several equal signals for training. Alternatively or additionally, the neural network can also be provided with information what is not to be detected or at the occurrence of which no action is to be triggered. This can, for example, be used to distinguish putting down a glass beside the collecting area 34, such as on a counter or the same, from putting down the same in the basin area 38, in order to refrain from letting out fluid when putting down takes place beside the basin.

The neural network can, for example, learn, detect and allocate characteristics of the central signal to specific actions, in particular, in a learning operation. A recognized event can then trigger the action. Even in other ways, active storage of sounds can take place, for example in a temporarily limited recording of a sound and storing the same in a data storage. In this way, for example, frequency analysis of the recorded sound can take place and characteristics thereof can be stored in a data storage.

According to an embodiment, a system described herein with the acoustic sensor means 22 is configured to receive the structure-born sound from the collecting area 34. The apparatus 10" can be configured to control, by controlling the actuator means 18, at least one of a flow rate of the fluid 14, a flow velocity of the fluid 14, a flow duration of the fluid 14, a focusing of the fluid 14 in the outlet area of the flow range 12, a temperature of the fluid 14 and a composition of the fluid from a plurality of fluid sources and/or a temperature of the fluid.

According to an embodiment, a system is configured such that the acoustic signal 24 is based on a putting-down sound in the collecting area and/or an object-related knocking sound at or in the collecting area 34. The apparatus 10" can be configured in the same way as the apparatus 10 or 10' in order to control the actuator means 18 based on different locations of origin $P_1$ to $P_7$ of the acoustic signal 24 and/or pattern in the acoustic signal. As patterns, not only the number of repetitions or the repetition rate but also possibly variable time intervals between transient events or the same can be evaluated.

According to an embodiment, a system described herein is configured to start the flow of the fluid 14 automatically or in dependence on a subsequent knocking sound when a container is put down in the collecting area 34. This can also describe a pattern in the context of the previous explanations, where two different evaluation results are expected in a specific temporal context to stop the flow. Thereby, it can be achieved, for example, that putting down a pot in the collecting area 34 does not automatically result in a start of the fluid outlet, for example, when merely dirty dishes are to be put down. If, however, within a predetermined time interval, an event, such as a knocking sound, e.g., by a finger and/or possibly at a predetermined location is received or detected, the flow can be started and/or a specific temperature can be adjusted or the same.

In that way, a system described herein can alternatively or additionally be configured to automatically stop the flow of the fluid 14 when a container is put down in a collecting area 34, as soon as the sensor signal indicates a filling or overfilling of the container, such as by performing a frequency analysis.

A system described herein can be configured to analyze a sound generated by the fluid in or at the collecting area with the sensor means 22 and the analysis means 28 and to adjust, by the actuator means 18, based on a correspondence with one of a plurality of different sounds, a focusing of the fluid from a plurality of different focusings allocated to the corresponding sound. Alternatively or additionally, the system can be configured to adjust, by the actuator means 18, based on a correspondence with one of a plurality of different sounds that are stored, for example, in a data storage, a flow rate of the fluid from a plurality of different flow rates allocated to the corresponding sound.

Figure 4:
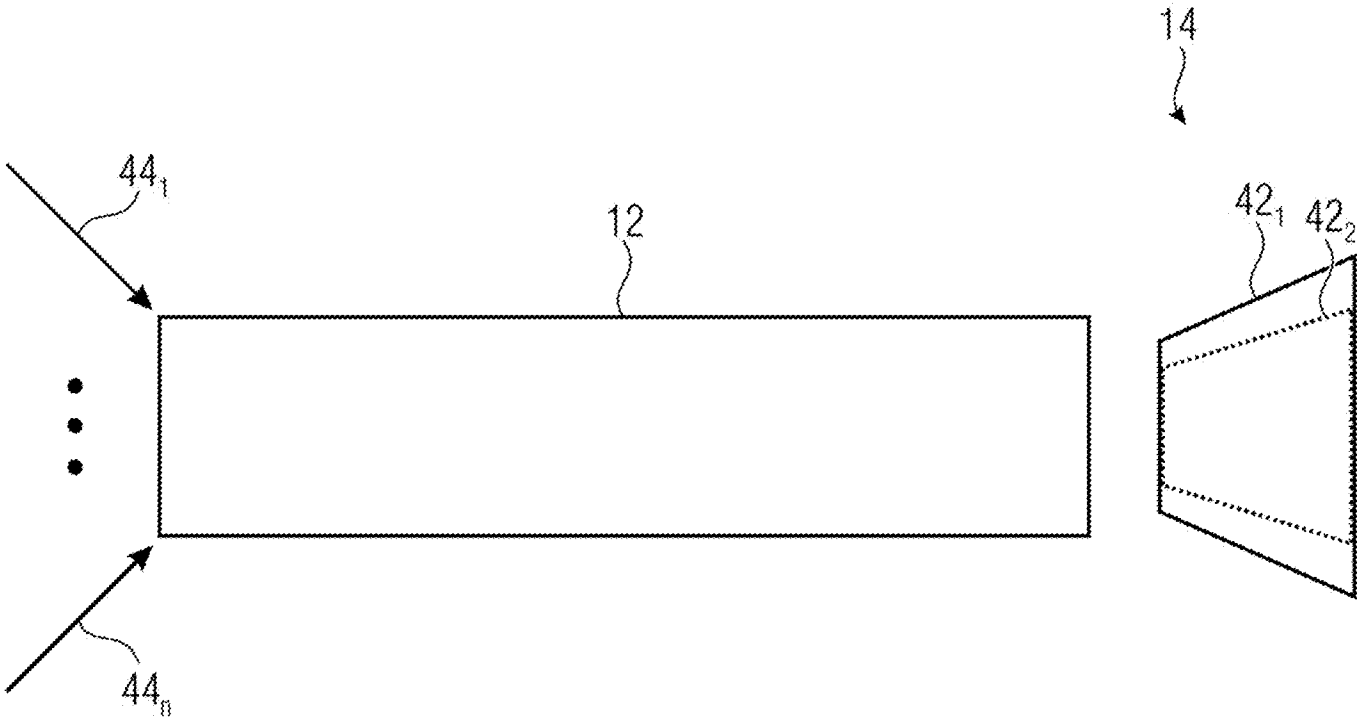
FIG. 4 is a schematic side sectional view of a flow range according to an embodiment.

FIG. 4 shows a schematic side sectional view of a flow range 12 outputting the fluid 14. The flow range 12 can be configured to adjust focusing 42 in dependence on an event detected in the sensor signal 26, such that, for example, when detecting a specific location of a knocking sound or when detecting a specific frequency spectrum corresponding, for example, with a knife to be rinsed, the jet is more focused (for example, $\mathbf{42}_2$) then when filling a pot or the same. The adjustment can be made between a plurality or multitude of at least two or even more different focusings.

Alternatively or additionally, the actuator means 18 can be configured to control one or several fluid sources $\mathbf{44}_1$ to $\mathbf{44}_n$ with n≥1 individually or in combination, wherein the fluid sources 44 can be combined to the fluid 14.

Figure 5:
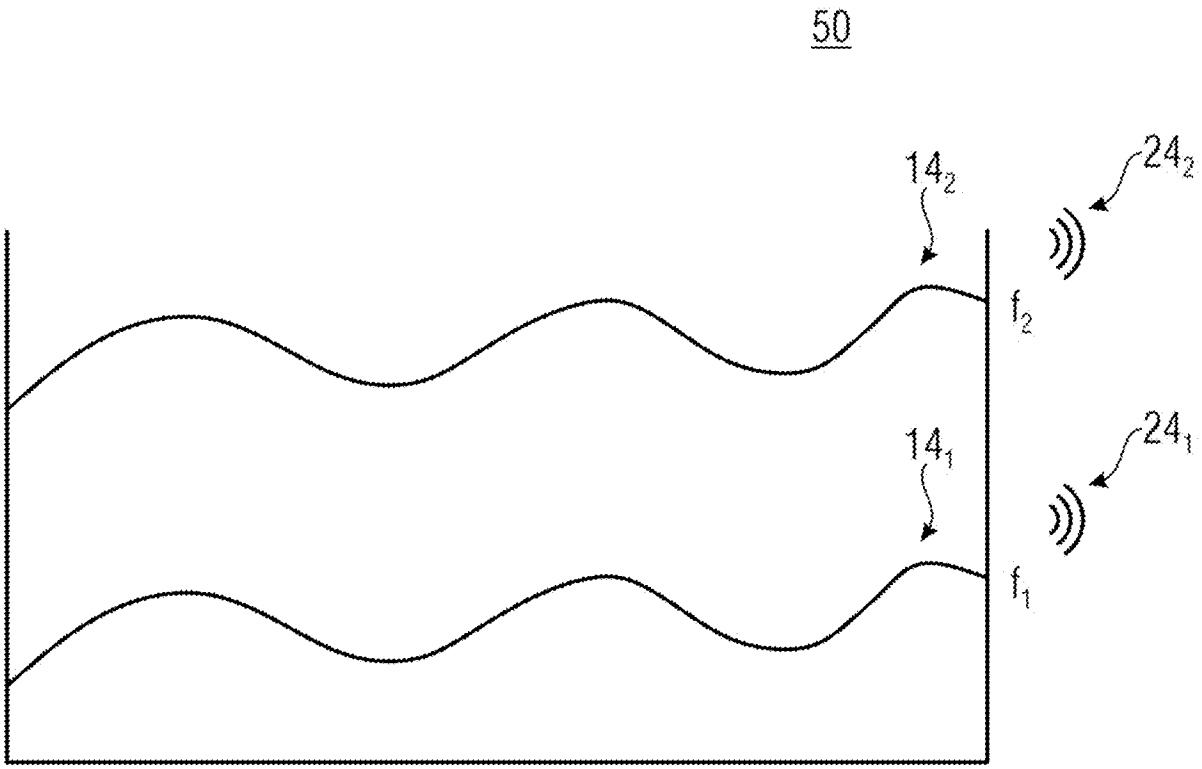
FIG. 5 is a schematic side sectional view of a container for discussing embodiments described herein.

FIG. 5 shows a schematic side sectional view of a container 50 which can be a source of the acoustic signal 24 at least, for example, for some actions of systems described herein.

Filling $\mathbf{14}_1$ with the fluid at a first rate can result in an emission of the acoustic signal $\mathbf{24}_1$ at a first frequency $f_1$. Increasing filling up to a level $\mathbf{14}_2$ can result in an emission of an acoustic signal $\mathbf{24}_2$ with a different and in particularly higher frequency $f_2$, which can be detected by the sensor means 22 and can be associated with an increasing filling degree by the analysis means 28.

Figure 6:
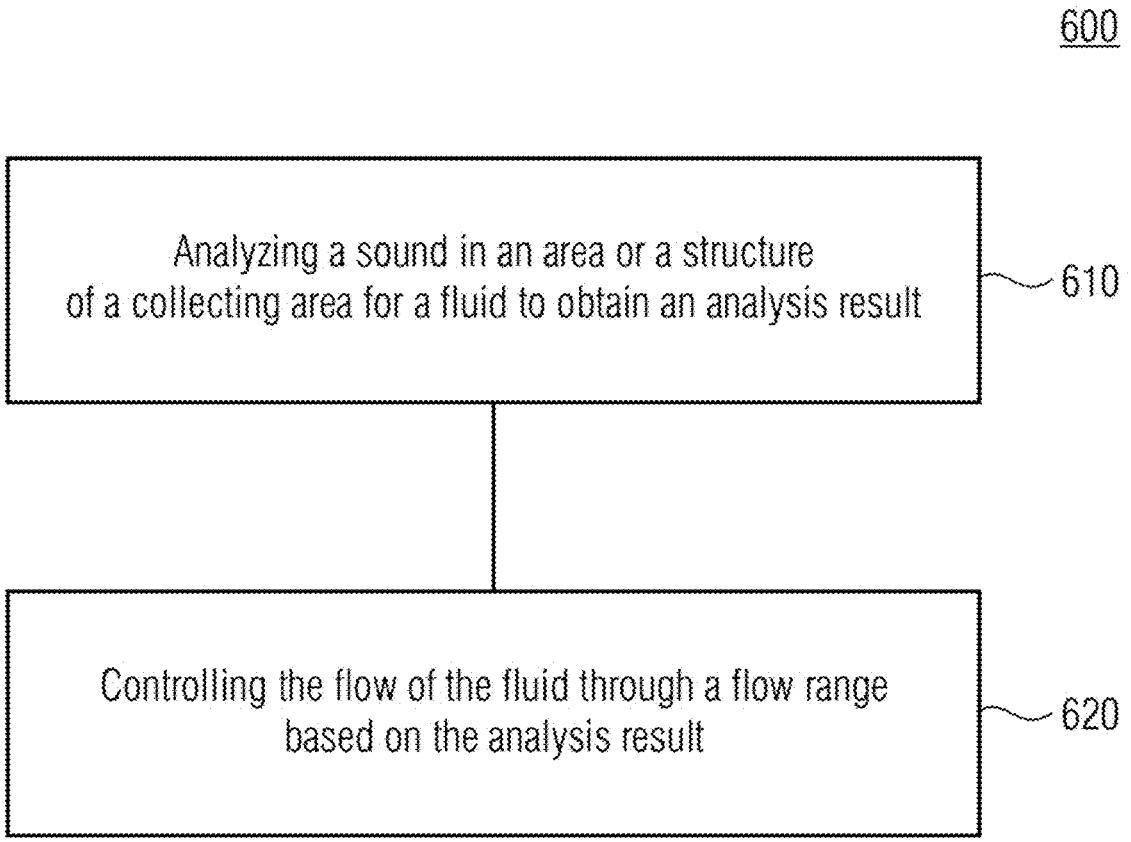
FIG. 6 is a schematic flow diagram of a method according to an embodiment.

FIG. 6 shows a schematic flow diagram of a method 600 according to an embodiment. The method 600 includes a step 610 of analyzing a sound in an area or a structure of a collecting area for a fluid to obtain an analysis result. A step 620 includes controlling the flow of the fluid through a flow range based on the analysis result.

Such a method can be configured such that perceived and evaluated sound can effect start or stop of the fluid flow. Thus, for example, an analysis of the sensor signal can be made in response to airborne sound and/or in response to predetermined characteristics in the sensor signals that are associated with a running fluid, such as white or colored noise included in airborne sound or structure-born sound. The method can be configured such that the sound includes a voice command, a mechanical contact with the area, such as a transient event or the structure of the collecting area, and controlling the flow, such as by means of an actuator means, includes starting or stopping the flow.

The method 600 can also be configured such that the sound is generated by the fluid and that controlling includes an adaption of the flow rate, the flow velocity, fluid temperature, stopping the flow or adjusting a focusing of the fluid during the outlet from the flow range. For this, the sound can be generated by fluid and controlling 620 can include adapting the flow rate, the flow velocity, the fluid temperature stopping the flow or adjusting a focusing of the fluid during outlet from the flow range.

In other words, embodiments of the present invention relate to the usage of one or several acoustic sensors in connection with an analysis unit for evaluating the acoustic signal and for detecting the purpose of water use, which is connected with switching on the water, switching off the water and/or a dosing system or a jet optimization system. According to a respective configuration, a system described herein or an apparatus described herein can be configured to detect different usages of water based on the sound of the water, e.g. entering sounds into a container (without generating any structure-born sound in the water basin), rinsing of plates or knifes, such as based on the structure-born sound in the basin. Alternatively or additionally, an apparatus described herein or a system described herein can be configured to distinguish between different containers into which the fluid flows, and in that way, for example, to distinguish between pots and glasses. Embodiments relate to detecting different subjects based on the putting-down sound of the subject into the basin and accordingly perform controlling of the flow range. further, embodiments relate to instructions by the user by acoustic commands, such as knocking in the basin, putting down a subject into the basin, combination of both actions, such as putting down a pot in the basin and subsequently knocking on the tap. According to an embodiment, apparatuses and/or systems are provided where a specifically learned operating sound or usage sound is stored for the amount of water, water temperature, and/or jet optimization. Embodiments allow the detection of voice commands and a respective control of the water extraction. Embodiments further relate to the usage of voice commands in combination with one or several of the above-stated detecting parameters or identifying parameters or characteristic parameters, such as when putting down a pot or detecting a pot as such, wherein the command "start water" includes filling the pot. This can differ, for example, from filling a glass and can be coupled to a different flow rate or a different temperature of the fluid, when first a glass is put down and then the same command "start water" is given.

Embodiments allow any combination of several detecting or identifying parameters, such as when putting down a pot, detecting the same as such and knocking on the tap to start filling of the pot.

Embodiments further relate to detecting "useless" water flow, for example detecting an overflowing pot, for example based on the change of sound when water runs over the edge of the pot. Alternatively or additionally, detecting a so-called useless water flow can take place by detecting the filled pot such as based on a change of sound during the filling of the pot.

Embodiments allow an improved or even optimum usage of the resource water or the filled fluid at user-controlled withdrawal points. A simplified and more efficient operation of fluid withdrawal points is provided. Time saving results not only by the low operating effort when opening the taps, but also during automatic switching-off, for example when the pot to be filled is filled. Further potentials are also in the field of kitchens, bathrooms, laboratories or the same.

Further fields of applications of embodiments described herein are detecting the filling level in filing plants, such as when bottling. Also, an application of detecting the filling level is generally possible when filling containers, such as when filling buckets, watering cans in gardens, slurry tankers in agriculture, rain barrels or the same. Embodiments can be used when detecting switching or dosing of solvents in different applications, for example for rinsing a tool in comparison to filling a transport container. Alternatively or additionally, it is possible to use embodiments for detecting and/or switching and/or dosing viscous liquids, such as concrete, liquid plastic or the same.

Therefore, embodiments are not limited to individual applications, but extend to all acoustically guided operations of fluid withdrawal points, in particular water withdrawal points.

Although some aspects have been described in the context of an apparatus, it is obvious that these aspects also represent a description of the corresponding method, such that a block or device of an apparatus also corresponds to a respective method step or a feature of a method step. Analogously, aspects described in the context of a method step also represent a description of a corresponding block or detail or feature of a corresponding apparatus.

Depending on certain implementation requirements, embodiments of the invention can be implemented in hardware or in software. The implementation can be performed using a digital storage medium, for example a floppy disk, a DVD, a Blu-Ray disc, a CD, an ROM, a PROM, an EPROM, an EEPROM or a FLASH memory, a hard drive or another magnetic or optical memory having electronically readable control signals stored thereon, which cooperate or are capable of cooperating with a programmable computer system such that the respective method is performed. Therefore, the digital storage medium may be computer readable.

Some embodiments according to the invention include a data carrier comprising electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, wherein the computer program is stored on a machine readable carrier.

In other words, an embodiment of the inventive method is, therefore, a computer program comprising a program code for performing one of the methods described herein, when the computer program runs on a computer. A further embodiment of the inventive method is, therefore, a data carrier (or a digital storage medium or a computer-readable medium) comprising, recorded thereon, the computer program for performing one of the methods described herein. The data carrier, the digital storage medium, or the computer-readable medium are typically tangible or non-volatile.

A further embodiment of the inventive method is, therefore, a data stream or a sequence of signals representing the computer program for performing one of the methods described herein. The data stream or the sequence of signals may, for example, be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array, FPGA) may be used to perform some or all of the functionalities of the methods described herein. In some embodiments, a field programmable gate array may cooperate with a microprocessor in order to perform one of the methods described herein. Generally, the methods are performed by any hardware apparatus. This can be a universally applicable hardware, such as a computer processor (CPU) or hardware specific for the method, such as ASIC.

While this invention has been described in terms of several advantageous embodiments, there are alterations, permutations, and equivalents, which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus, comprising:

a flow range configured to let a fluid comprising a fluid characteristic flow;

an actuator configured to change the flow characteristic of the flow range;

an acoustic sensor configured to receive an acoustic signal and to output a sensor signal based on the acoustic signal;

an analyzer configured to analyze the sensor signal to acquire an analysis result;

wherein the apparatus is configured to control the actuator based on the analysis result for changing the flow characteristic;

wherein the analyzer is configured to analyze the sensor signal continuously or repeatedly over time for a sensor signal characteristic during a flow of the fluid, wherein an increasing filling level of a container filled with fluid correlates with a change of the sensor signal characteristic, wherein the apparatus is configured to control the actuator to stop a flow of the fluid and to prevent overflow of the container based on reaching a predetermined sensor signal characteristic or a predetermined change of the sensor signal characteristic and/or wherein the analyzer is configured to analyze the sensor signal for a sensor signal characteristic of a transient event and to make a comparison with a plurality of predetermined sensor signal characteristics to acquire the analysis result, wherein the apparatus is configured to control the actuator based on a similarity with one of the plurality of predetermined sensor signal characteristics; wherein a different control of the actuator is allocated to each of the plurality of sensor signal characteristics.

2. Apparatus according to claim 1, wherein the acoustic sensor is configured to receive structure-borne sound of a collecting area and to output the sensor signal based on the structure-born sound.

3. Apparatus according to claim 1, wherein the acoustic sensor is configured to receive airborne sound and to output the sensor signal based on the airborne sound.

4. Apparatus according to claim 1, wherein the fluid is a liquid, in particular, water.

5. Apparatus according to claim 1, wherein the flow characteristic is at least one of:

a beginning or an end of the flow;

a flow rate of the fluid;

a flow velocity of the fluid;

a flow duration of the fluid;

a focusing of the fluid in an outlet area of the flow range;

a composition of the fluid from a plurality of fluid sources;

a temperature of the fluid.

6. Apparatus according to claim 1, wherein the analyzer is configured to analyze the sensor signal continuously or repeatedly over time for the sensor signal characteristic during a flow of the fluid, wherein the apparatus is configured to control the actuator to stop a flow of the fluid based on reaching a predetermined set value or a threshold of the sensor signal characteristic.

7. Apparatus according to claim 1, configured to control the actuator to stop the flow of the fluid based on information in the sensor signal that a container to be filled with the fluid is filled or flows over.

8. Apparatus according to claim 1, wherein the analyzer is configured to analyze the sensor signal for a plurality of subsequent repetitions of a transient event to acquire the analysis result, wherein the apparatus is configured to control the actuator differently based on different numbers.

9. Apparatus according to claim 1, wherein the analyzer is configured to analyze the sensor signal for a spectrum of a transient event and to make a comparison with a plurality of predetermined spectra to acquire the analysis result, wherein the apparatus is configured to control the actuator based on a similarity with one of the plurality of predetermined spectra; wherein a different control of the actuator is allocated to each of the plurality of spectra;

wherein the plurality of different spectra are associated with at least one of:

a location of origin of the transient event;

a condition of the object triggering the transient event.

10. Apparatus according to claim 1, wherein the analyzer is configured to analyze the sensor signal for a voice command; wherein the apparatus is configured to control the actuator according to a detected voice command.

11. Apparatus according to claim 1 configured for a learning operating mode and an execution mode and configured to acquire at least one piece of information regarding a sensor signal in a learning mode, such as from the acoustic sensor, and to acquire one piece of information regarding control of the actuator and to combine the information regarding the sensor signal with the information regarding the control, wherein the apparatus is configured to execute, in the execution mode, the control of the actuator based on the matter learned in the learning operating mode.

12. Apparatus according to claim 1 that is formed as water tap, filling level monitoring unit, rinsing unit or dosing unit.

13. System comprising an apparatus according to claim 1 and a collecting area formed as a wash basin.

14. System according to claim 13, wherein the acoustic sensor is configured to receive structure-borne sound from the collecting area; wherein the apparatus is configured to control, based on different characteristics of the structure-borne sound, by controlling the actuator, at least one of: a flow rate of the fluid; a flow velocity of the fluid; a flow duration of the fluid; a focusing of the fluid in an outlet area of the flow range; a temperature of the fluid; and a composition of the fluid from a plurality of fluid sources.

15. System according to claim 13, wherein the acoustic signal is based on a putting-down sound in the collecting area and/or an object-related knocking sound at or in the collecting area; wherein the apparatus is configured to control the actuator differently based on different locations of origin of the acoustic signal and/or patterns in the acoustic signal.

16. System according to claim 13 configured to start the flow of the fluid automatically or in dependence on a subsequent knocking sound when putting down a container in the collecting area.

17. System according to claim 13 configured to stop the fluid automatically when putting down a container in the collecting area as soon as the sensor signal indicates filling or overfilling of the container.

18. System according to claim 13 configured to analyze a sound generated by the fluid in or at the collecting area by the sensor and the analyzer and to adjust, with the actuator, based on a correspondence with one of a plurality of different sounds, a focusing of the fluid from a plurality of different focusings allocated to the corresponding sound; and/or to adjust, with the actuator, based on a correspondence with one of a plurality of different sounds, a flow rate of the fluid from a plurality of different flow rates allocated to the corresponding sound.

19. System, comprising:

an apparatus formed as tap, comprising a flow range configured to let water comprising a fluid characteristic flow;

an actuator configured to change the flow characteristic of the flow range;

an acoustic sensor configured to receive an acoustic signal and to output a sensor signal based on the acoustic signal;

an analyzer configured to analyze the sensor signal to acquire an analysis result;

wherein the apparatus is configured to control the actuator based on the analysis result for changing the flow characteristic;

a wash basin as collecting area for the water;

wherein the acoustic signal is based on a putting-down sound in the collecting area and/or an object-related knocking sound at or in the collecting area; wherein the apparatus is configured to control the actuator differently based on different locations of origin of the acoustic signal and/or patterns in the acoustic signal.

20. Method, comprising:

analyzing a sound in an area or structure of a collecting area for a fluid to acquire an analysis result;

controlling the flow of the fluid through a flow range based on the analysis result;

such that the sensor signal is analyzed continuously or repeatedly over time for a sensor signal characteristic during a flow of the fluid, such that an increasing filling level of a container filled with fluid correlates with a change of the sensor signal characteristic, such that based on reaching a predetermined sensor signal characteristic or a predetermined change of the sensor signal characteristic the actuator is controlled to stop a flow of the fluid and to prevent overflow of the container and/or such that the sensor signal is analyzed for a sensor signal characteristic of a transient event and a comparison with a plurality of predetermined sensor signal characteristics is made to acquire the analysis result, such that the actuator is controlled based on a similarity with one of the plurality of predetermined sensor signal characteristics; such that a different control of the actuator is allocated to each of the plurality of sensor signal characteristics.

21. Method according to claim 20, wherein the sound is generated by the fluid and controlling comprises adapting the flow rate, the flow velocity, fluid temperature, stopping the flow or adjusting the focusing of the fluid during the outlet from the flow range.

22. A non-transitory digital storage medium having a computer program stored thereon to perform the method comprising:

analyzing a sound in an area or structure of a collecting area for a fluid to acquire an analysis result;

controlling the flow of the fluid through a flow range based on the analysis result;

such that the sensor signal is analyzed continuously or repeatedly over time for a sensor signal characteristic during a flow of the fluid, such that an increasing filling level of a container filled with fluid correlates with a change of the sensor signal characteristic, such that based on reaching a predetermined sensor signal characteristic or a predetermined change of the sensor signal characteristic the actuator is controlled to stop a flow of the fluid and to prevent overflow of the container and/or such that the sensor signal is analyzed for a sensor signal characteristic of a transient event and a comparison with a plurality of predetermined sensor signal characteristics is made to acquire the analysis result, such that the actuator is controlled based on a similarity with one of the plurality of predetermined sensor signal characteristics; such that a different control of the actuator is allocated to each of the plurality of sensor signal characteristics, when said computer program is run by a computer.

* * * * *